US005527248A

United States Patent [19]

Crivello

[11] Patent Number: 5,527,248

[45] Date of Patent: Jun. 18, 1996

[54] VARIABLE CONTROLLED TRACTION EXERCISE APPARATUS

[76] Inventor: James P. Crivello, 15018 189th Ave., Woodinville, Wash.

[21] Appl. No.: 167,501

[22] Filed: Dec. 15, 1993

[51] Int. Cl.[6] ..... A63B 23/02

[52] U.S. Cl. ..... 482/96; 982/133; 982/907

[58] Field of Search ..... 482/51, 57–59, 482/62–65, 72, 73, 93–103, 112, 113, 123, 130, 133–137

[56] References Cited

U.S. PATENT DOCUMENTS

| | | | |
|---|---|---|---|
| 1,973,945 | 9/1934 | Chavin et al. | 272/58 |
| 2,405,024 | 7/1946 | Eynon . | |
| 2,454,656 | 11/1948 | Kollman | 482/57 X |
| 2,470,544 | 5/1949 | Bell | 482/96 |
| 2,544,106 | 3/1961 | Ray | 482/51 X |
| 2,973,029 | 2/1961 | Schlosstein | 155/173 |
| 3,380,737 | 4/1968 | Elia et al. . | |
| 4,084,810 | 4/1976 | Forsman | 482/57 X |
| 4,429,871 | 2/1984 | Flechner | 272/130 |
| 4,583,731 | 4/1986 | Crivello et al. | 272/144 |
| 4,632,393 | 12/1986 | Van Noord . | |
| 4,743,010 | 5/1988 | Geraci . | |
| 4,819,936 | 4/1989 | Muller . | |
| 4,883,268 | 11/1989 | Salkind . | |
| 5,108,090 | 4/1992 | Reed . | |
| 5,110,121 | 5/1992 | Foster . | |
| 5,178,599 | 1/1993 | Scott | 482/51 X |
| 5,184,991 | 2/1993 | Brangi | 482/97 |
| 5,288,130 | 2/1994 | Foster . | |
| 5,299,997 | 4/1994 | Chen . | |
| 5,299,998 | 4/1994 | Hutchins . | |
| 5,322,489 | 6/1994 | Webb et al. | 482/100 X |
| 5,342,269 | 8/1994 | Huang et al. . | |

FOREIGN PATENT DOCUMENTS

| | | | |
|---|---|---|---|
| 1929340 | 3/1970 | Germany | 482/142 |

*Primary Examiner*—Richard J. Apley
*Assistant Examiner*—John Mulcahy
*Attorney, Agent, or Firm*—James E. Bradley

[57] ABSTRACT

Variable controlled traction exercise apparatus for exercising a lumbar region of a user in a controlled manner using a variable amount of the body weight of the user to provide traction includes a frame, a handle, strap or harness, etc., for maintaining at least a portion of an upper body or appendage of the user at a generally fixed position relative to the frame, and a pivotal seat assembly which includes a knee/shin support and a foothold attached to the pivot axle. The seat assembly pivots to move between a raised, forward position to a rearward, lowered position. The user sits on the seat and engages the handle, strap or harness and applies a variable traction to the lumbar region by controlling the pivotal movement of the seat assembly relative to the handle, strap or harness.

6 Claims, 7 Drawing Sheets

VARIABLE CONTROLLED TRACTION EXERCISE APPARATUS

COPYRIGHT NOTICE

© Copyright 1993, James R. Vance. All Rights Reserved.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to apparatus for providing variable controlled traction to a lumbar region of a user or operator. More particularly, this invention relates to apparatus for exercising and strengthening the lumbar region of the user by enabling the user to stretch the muscles in his or her back in a controlled manner using a variable amount of the body weight of the user to provide traction.

BACKGROUND ART

There has been a longstanding need within the medical, therapeutic, health, body-building, and exercise communities, for a safe, inexpensive, efficient apparatus that will provide controlled traction of the lumbar region of a patient and/or user. In an attempt to meet this need, numerous different therapeutic and exercise equipment have been created. For example, traction machines, body-building equipment, rowing machines, exercise bikes, and other apparatus have been used for years and are well known within such communities.

Prior to the advent of complex exercise equipment, weights such as barbells and dumbbells were the primary apparatus used to provide traction and to develop musculature and cardiovascular strength. Barbells and dumbbells are still heavily used and can be manipulated independently or may be placed upon or within a stationary exercise apparatus. For example, barbells and dumbbells are often secured or connected via cables directly to the patient to provide the needed traction.

Alternatively, the barbells and dumbbells can be secured or connected via cables to a pivotal crank or lever and thereby provide resistance to pivotal motion. Physical work may be exerted against the crank to raise the elevation of the barbells and/or dumbbells. Gravity pulling the weights downward provides the resistive force. The amount of resistive force may be modified by either varying the weight of the barbell or dumbbell used, or by varying the distance between the weight or cable and the pivotal axis of the crank.

Users of barbells and dumbbells are often injured by accidentally dropping heavy, bulky, and awkward weights. Even when weights are incorporated into the design of a stationary exercise station, such as found in the equipment sold under the trademarks UNIVERSAL and NAUTILUS, there still remains a danger that clothing and/or human appendages may become pinched between moving weights.

Recently, elastic bands have been used to replace the aforementioned massive weights. A well-known exercise machine that uses elastic bands to provide resistive force is sold under the trademark SOLOFLEX. The resistive force of such machinery may be modified by either varying the size and thereby tensile strength of the elastic bands, or by varying the distance between the elastic bands and the pivotal axis of the crank.

Equipment using elastic bands suffers from many of the same difficulties inherent with weights. For example, injury can easily occur if the handlebar is released before the tension within the elastic bands returns to a relaxed state.

Equipment having elongated pneumatic or hydraulic cylinders that are mounted away from or remote to a crank's pivot point have also been created. Typically, such equipment comprises a larger cylinder, one end of which is attached to a stationary frame. A telescopic piston is located within the larger cylinder. One end of an elongated rod is secured to the piston and the other end of the rod is secured to a pivotal crank. Use of pneumatic or hydraulic cylinders gives the added benefit of variable resistance, which is obtained by controlling the flow of air or liquid within the larger cylinder.

Some of the difficulties and dangers of using pneumatic or hydraulic cylinders include exposing the user to grease, oils and lubricants that are found on the extended piston rod, and unintentionally pinching clothing and/or limbs and fingers of the user or of a spectator. More particularly, the close proximity between lubricated rods and a user increases the likelihood that clothing, equipment, and/or the body of the user will become soiled and slippery. This in turn increases the likelihood that injury will occur by the user slipping or falling, or by loosing a grip on a weight machine or other apparatus. There is also the danger that clothing, skin, a limb, or even a finger may become pinched between the scissored cylinder, crank, and stationary frame. The throw and angle of pivot of such devices are also severely limited due to the restrictions inherent with using elongated, piston driven cylinders.

With the exception of the present invention, most currently known muscle building exercise equipment are extremely complex, expensive to manufacture, difficult to use and understand, and present various dangers to the user. Such equipment typically have numerous weights, pins, cables, seats, handlebars, and other attachments and accessories. Properly attaching these elements within the equipment is often time consuming and confusing. Incorrect attachment of any of such elements could cause sever injury to the user and expose the instructor, athletic club, seller, and manufacturer to lawsuits for negligence and product liability.

The inventor believes that the above-cited apparatus and methods taken alone or in combination neither anticipate nor render obvious the present invention. These citations do not constitute an admission that such disclosures are relevant or material to the present claims. Rather, these citations relate only to the general field of the disclosure and are cited as constituting the closest art of which the inventor is aware.

DISCLOSURE OF INVENTION

The present invention is a compact, functional, efficient, reliable, reusable, durable, rugged, easily constructed, extremely simple to use, inexpensive and economical to manufacture apparatus that requires minimal setup time and manipulation. The present invention not only increases the speed and simplifies the procedure in setting up equipment to exercise the arms and lumbar region of a user, the invention also provides an unobtrusive apparatus that does not necessarily require the use of barbells, dumbbells, weights, or elastic bands. The present invention also provides a greatly enhanced, variably controlled traction exercise of the lumbar region, without exposing the user to danger. In addition, the present invention overcomes all of the previously mentioned disadvantages.

To achieve these general and specific objectives the present invention generally comprises: (a) a frame; (b) means secured to the frame for maintaining the hands, wrists, forearms, or arms of the user at a generally fixed position relative to the frame; and (c) a seat assembly that is capable of pivotal motion relative to the frame.

The frame may take any desired form that is capable of supporting at least a portion of the weight of the user. The frame should be capable of supporting the user in a generally upright seated position. It is preferred that the frame be an independent element from a generally horizontal, underlying support structure or floor. It is intended that during use, the frame is placed upon and supported by the underlying support structure.

Alternatively, the frame may comprise one or more braces that are permanently secured to, imbedded into, or formed integrally with the underlying support structure.

In addition, the support frame can be cantilevered or suspended from a wall, ceiling, or other element that is elevated above the underlying support structure or floor.

The frame may take any of the aforementioned forms as long as the user is supported and can move between a raised position and a variable lower position that will be described in greater detail below.

In the preferred embodiment of the invention, the frame comprises a base assembly and an elongated upwardly extending column. The base assembly has an elongated base member and one or more elongated stabilizing members. For example, the centrally located base member may have a first end and an opposed second end. A first elongated stabilizing member is secured to the first end of the base member. The first stabilizing member can have a generally perpendicular orientation with respect to the base member, thereby forming a planar support base assembly having a general T-shape or configuration.

If desired, a second elongated stabilizing member can be secured to the second end of the base member. The second stabilizing member may also have a generally perpendicular orientation with respect to the base member. The second stabilizing member would be generally parallel to the first stabilizing member. This structure would impart a general H-shape, configuration, or appearance to the base assembly.

Alternatively, other shapes and/or configurations could be used. For example, the base assembly may simply comprise a planar, square-shaped, rectangular-shaped, triangular-shaped, circular-shaped, oval-shaped, or other shaped platform.

In the preferred embodiment of the invention, an elongated upwardly extending column is secured to the base assembly. For example, the column may have a first end and an opposed second end. The first end of the column would be secured to the base assembly, and preferably to the base member. The column extends from the base member in a generally upward direction away from the support structure. The first end of the column could even be secured to the first stabilizing member.

Alternatively, the first end of the column could be independently secured to the support structure, thereby, eliminating the need for its attachment to a base assembly. In essence, the support structure would serve and function as the aforementioned base assembly.

Depending upon the dimensions and placements of the various elements of the invention, it may be preferable to use a column that has a generally serpentine configuration. The purpose of such serpentine configuration will be discussed at greater length further below.

It may also be desirable to use a column that can be telescopically extended and/or contracted. For example, the column may be provided with an elongated first column portion and a second column portion.

As discussed herein, telescopic extension and/or contraction should be interpreted to include any and all forms of coupling between the respect parts that allow for elongation and/or contraction, including the slidable and/or rotatable coupling of such elements.

The first column portion would have a first end and an opposed second end. In the preferred embodiment of the invention, the first end of the first column portion is secured to the base member. The first column portion then extends from the base member in a generally upward direction away from the support structure.

The second column portion is capable of telescopically mating with the second end of the first column portion. In essence, the second column portion defines the second end of the column. The length of the column can be selectively adjusted by telescopically extending or contracting the second column portion with respect to the first column portion.

Where it is desirable to use a telescopic column having a serpentine configuration, the first column portion is provided with a generally serpentine configuration.

As mentioned above, the second primary element of the invention comprises means for maintaining the hands, wrists, forearms, and/or arms of the user at a generally fixed position relative to the frame. For example, such maintaining means may comprise a harness, strap, belt, clamp, handle, cuff, platform, or bar that is secured to the frame. Consequently, depending upon which form of maintaining means is used, the invention may be operated by both healthy operators and persons who suffer from a physical handicap. Furthermore, the user can exercise a wide variety of different upper body muscles using the present invention.

In the preferred embodiment of the invention, the maintaining means comprises at least a first handlebar that is secured to the frame. The first handlebar is positioned generally above and forward of the seat assembly, which will be discussed at length below.

The first handlebar may be formed integrally within the column or be securely attached to the column.

The first handlebar may also be cantilevered outward from the frame. It is preferred that the first handlebar be cantilevered outward from the frame in such a manner that at least a portion of the first handlebar extends in a direction generally backward toward the seat assembly.

The handlebar may also be pivotally secured to the frame. Once a desired pivotal orientation is obtained, the handlebar is fixedly secured to the frame. For example, the frame may be provided with means to orient the first handlebar at any one of a plurality of different pivotal or radial positions with respect to the frame.

The first handlebar may also be provided with means for telescopically mating with the frame. This structure enables the length, width, or breadth of the cantilevered portion of the first handlebar to be increased or decreased as needed. In other words, the first handlebar may be provided with means for selectively adjusting its extended length or ultimate position by telescopically extending or contracting the first handlebar with respect to the frame.

Thus far, discussion of the maintaining means has generally been restricted to use of a first handlebar. It should be understood that such maintaining means may further comprise a second handlebar that is similarly secured to the frame. The second handlebar can be similarly positioned generally above and forward of the seat assembly. The second handlebar may be similarly pivotally and/or telescopically secured to the frame. In the preferred embodiment, during use, the second handlebar has a generally coplanar or parallel orientation with respect to the first handlebar.

The structure and function of the pivotal seat assembly are very important to the operation of the invention. In essence, the seat assembly comprises an elongated crank or lever and a seat that is secured to the crank. For example, the elongated crank or lever may have a first end and an opposed second end. The crank is then pivotally secured to the frame, and more particularly to the base assembly, near the first end of the crank.

To enable the crank to be pivotally secured to the frame, the frame may be provided with a first brace fixedly secured thereto. The crank is then pivotally secured to the extended first brace.

In the preferred embodiment of the invention, the frame is actually provided with the aforementioned first brace and with a similar, corresponding second brace. The second brace is similarly secured to the frame. However, the second brace is positioned near the first brace in a spaced relationship to the first brace. Consequently, the crank is pivotally secured to both the first brace and to the second brace.

The crank may be pivotally secured to the first and second braces by means of using an elongated pivot pin that passes through mated bore holes located within: the extended first brace; the crank, near the first end of the crank; and the extended second brace. The pivot pin actually defines a fixed first axis of rotation for the seat assembly. The crank and seat assembly are thereby enabled to pivot or rotate between a raised, forward position and a variably located, lower, rearward position, or anywhere therebetween.

For convenience and comfort of the user, and for proper placement of the legs of the user upon the apparatus, a first foothold may be secured to the frame. It is preferred that the first foothold be pivotally secured to the frame by means of the aforementioned elongated pivot pin that also passes through one or more mated bore holes located within the first foothold.

A second foot hold may also be provided. The second foothold is similarly secured to the frame, with the elongated pivot pin also passing through one or more mated bore holes that are located within the second foothold.

The apparatus of the invention may further be provided with adjustment means for selectively adjusting and/or limiting the backward stroke or throw of the crank. In other words, the adjusting means defines or limits the variable, lower, rearward position of the seat assembly. The adjustment means can be secured to the crank, to the frame, or to both.

Means for limiting the forward stroke and raised, forward position of the crank and seat assembly may also be provided. For example, the aforementioned serpentine column may be positioned to restrict or limit the forward stroke or throw of the crank.

Means for absorbing the impact between the crank and the frame at the limit of the forward stroke can also be provided. For example, such impact absorbing means may comprise a rubber or other impact absorbent bumper that is secured to the crank and/or to the frame.

The column was previously described as being capable of being telescopically extended and/or contracted. In a similar manner, the crank may be provided with means for telescopic elongation and contraction. For example, the crank may be provided with an elongated first crank portion that has a first end and an opposed second end. The first crank portion is then pivotally secured to the frame near the first end of the first crank portion. The first crank portion extends from the frame in a generally upward direction away from the support structure.

In this embodiment of the invention, the crank is also provided with a second crank portion that is capable of being telescopically mated with the second end of the first crank portion. In essence, the second crank portion defines the second end of the crank. The length of the crank may be selectively adjusted by telescopically extending or contracting the second crank portion with respect to the first crank portion.

The seat assembly may also have a knee and/or shin support assembly that is secured to the crank. For example, the knee and/or shin support assembly may comprise a stationary padded structure or cushion that is secured to the crank upon which the user may urge his or her shin.

Alternatively and preferably, the knee and/or shin support assembly comprises a first pair of padded rollers that are pivotally and/or rotatably secured to the crank at one or more locations along the length of the elongated crank. The first pair of padded rollers may be secured to the crank near the second end of the crank.

The knee and/or shin support assembly may further comprise a second pair of padded rollers that are pivotally and/or rotatably secured to the crank near the first pair of padded rollers.

The knee and/or shin support assembly may further comprise a third pair or additional pairs of padded rollers that are pivotally and/or rotatably secured to the crank near the second pair of padded rollers.

Where two or more pairs of padded rollers are used, such rollers are preferably positioned to maximize the comfort and/or support of the user or operator when the apparatus is being used. To increase such comfort, the padded rollers may be positioned along a generally arcuate path along the elongated crank. The arcuate path is intended to approximate the curvature of the shin of the user when seated upon the invention.

In the preferred embodiment of the invention, the seat assembly is also provided with an elongated seat support that has a first end and an opposed second end. The first end of the seat support is secured to the crank. The seat support then extends from the crank in a generally upward direction away from the crank.

Although not absolutely necessary, the elongated seat support may also be capable of being telescopically elongated and/or contracted. For example, the seat support may comprise an elongated first seat support portion having a first end and an opposed second end. The first end of the first seat support portion is secured to the crank. The first seat support portion then extends from the crank in a generally upward direction away from the crank.

The seat support also has a second seat support portion that is capable of telescopically mating with the second end of the first seat support portion. The second seat support portion defines the second end of the seat support. The length of the seat support is thus capable of being selectively adjusted by telescopically extending and/or contracting the second seat support portion with respect to the first seat support portion.

The seat assembly also has a seat attached thereto. The seat assembly is preferably secured or attached to the second end of the seat support, such as to the second seat support portion.

The seat may take any appropriate form or configuration. For example, the inventor prefers that the seat have a generally elongated, trapezoidal configuration with its apex positioned nearer to the front of the invention toward the handlebars.

Although not required, the seat may be pivotally secured to the seat support so that the seat can pivot toward and away from the maintaining means, such as the handlebars. In other words, the seat may pivotally oscillate through an arc or arcuate path generally about a second axis of rotation relative to the seat support. When the underlying support structure has a generally horizontal orientation, the second axis of rotation preferably also has a generally horizontal orientation.

The apparatus of the present invention may also be provided with means for urging the seat assembly to return to its raised, forward position. Such urging means is preferably secured to the frame and to the seat assembly.

The urging means may comprise a spring or an elastic member or band that does not necessarily provide resistive forces for exercising the lumbar regions of the user, but rather is intended simply to pull or push the seat back to its upright position when the apparatus is not in use.

Alternatively, such urging means may comprise a cable and related linkages, pulley rollers, and a powered motor that can be activated to pull and/or push the seat assembly back to its raised, forward position. This embodiment of the invention is particularly helpful for persons who do not have sufficient upper body strength to pull their own weight back to the raised position. In essence, the motor and cable assembly serves to assist the user to move back to the raised position.

Means for actuating such urging means at a predetermined location or upon a particular condition may also be provided.

These and other objectives and advantages of the present invention will become more readily apparent upon reading the following disclosure and referring to the attached drawings.

One should understand that the drawings are not necessarily to scale and the elements are sometimes illustrated by graphic symbols, phantom lines, diagrammatic representations, and fragmentary views. In certain instances, the inventor may have omitted details that are not necessary for an understanding of the present invention or which render other details difficult to perceive.

BEST MODE FOR CARRYING OUT THE INVENTION

Figure 1:
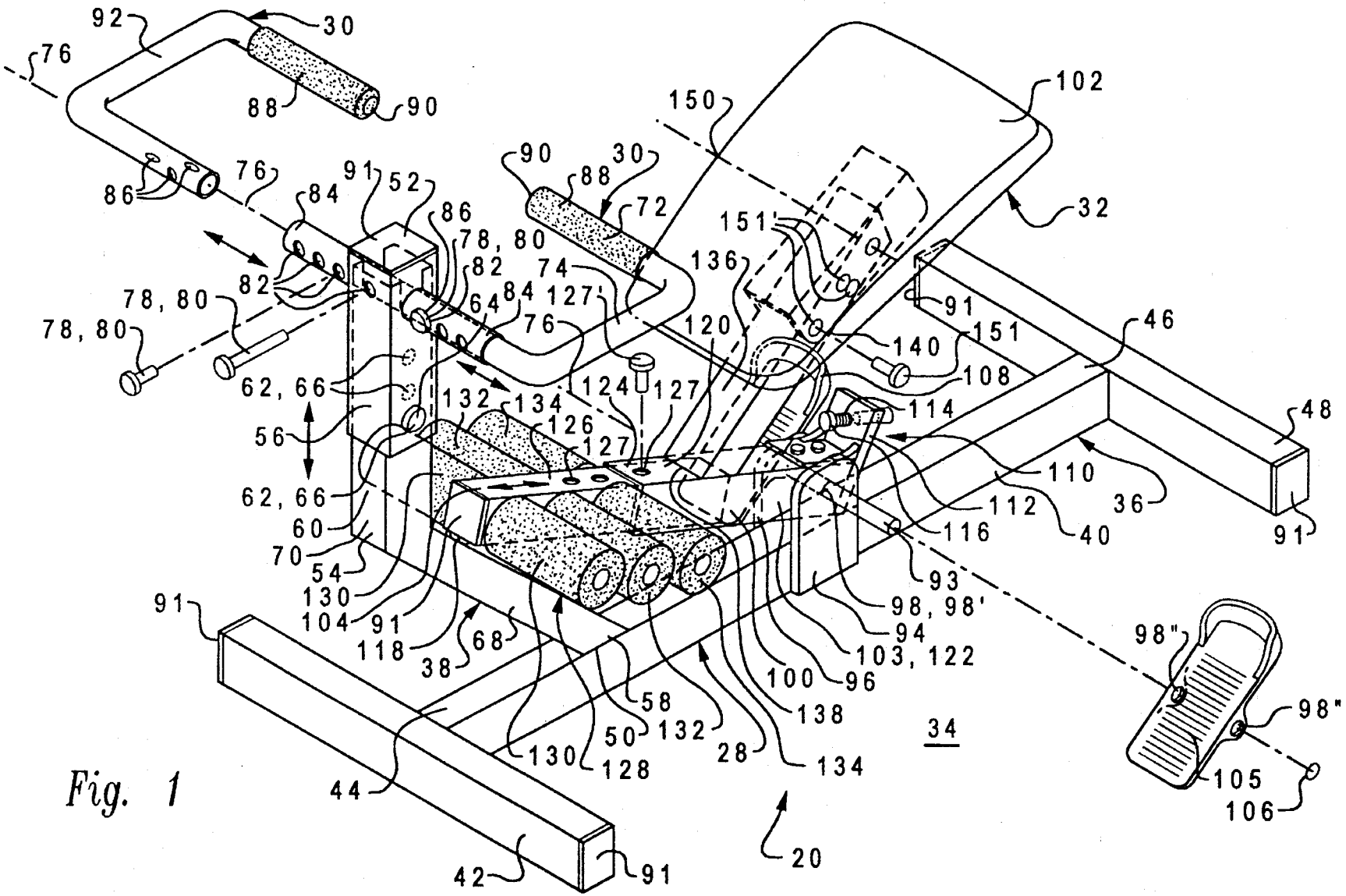
FIG. 1 is a partially exploded, isometric view of a preferred embodiment of the present invention.

Referring to the drawings and particularly to FIG. 1, wherein like numerals indicate like parts, the present invention comprises apparatus 20 for stretching, exercising, and strengthening the arms 22 and lumbar region 24 of a user 26. To accomplish these ends, and the aforementioned objectives, apparatus 20 generally comprises: (a) a frame 28; (b) means 30 for maintaining at least a portion of the upper body or appendage(s) of user 26 at a generally fixed position relative to frame 28; and (c) a pivotal seat assembly 32. Each of these structural elements will be discussed in successive order.

Frame 28 supports at least a portion of the weight of user 26. Frame 28 is also capable of placing user 26 within a generally upright seated position.

Frame 28 may be defined by one or more braces, spans, brackets, flanges, or other structural elements that are permanently secured to, imbedded into, or formed integrally with an underlying support structure 34 or floor.

Support structure 34 does not necessarily have to define a generally horizontal plane. This invention can be equally effective on inclined planes and/or irregular surfaces. For example, support frame 28 may be cantilevered or rigidly suspended from a wall, ceiling, or other element that is elevated above underlying support structure 34. Frame 28 could also be placed within or be secured to a movable object such as to a portable gym, truck, van, trailer, platform, airplane, boat, ship, or the like.

In the preferred embodiment of the invention, frame 28 comprises a structural element that is independent and separable from support structure 34. Frame 28 simply rests upon support structure 34 in a similar manner as do many of the aforementioned conventional exercise equipment. Frame 28, however, must have sufficient structural integrity to provide a stable platform for the support of user 26 and enable the safe operation of apparatus 20. In essence, frame 28 must allow user 26 to move through an arc or arcuate path between a raised position and a variable lower position.

As seen in the accompanying Figures, the preferred embodiment of frame 28 comprises a base assembly 36 and an elongated, upwardly extending column 38.

In its simplest form, base assembly 36 may comprise a flat planar member that simply rests upon the floor or support structure 34. Base assembly 36 has a sufficient length, span or width, and thickness to prevent apparatus 20 from tipping over during use. Base assembly 36 may have any desired shape and/or configuration. For example, base assembly 36 may have a square, rectangular, triangular, circular, oval, or any other desired shape.

Base assembly 36 may be manufactured or molded from a single element. Alternatively, base assembly 36 may comprise an assemblage of more than one element that are combined together.

Within the preferred embodiment of the invention, base assembly 36 comprises the combination of an elongated base member 40 and at least an elongated, first stabilizing member 42. Base member 40 has a centrally extending orientation with respect to the overall appearance of apparatus 20. Base member 40 has a first end 44 and an opposed second end 46.

First stabilizing member 42 is secured to first end 44 of base member 40 by any appropriate means, such as by welding, or use of bolts and nuts, screws, clamps, and/or the like.

It is intended that first stabilizing member 42 has a general perpendicular orientation with respect to base member 40. Consequently, base member 40 and first stabilizing member 42 form a planar support having a general T-shape or configuration.

Other shapes and/or configurations could alternatively be used. For example, an elongated, second stabilizing member 48 may be secured to second end 46 of base member 40.

Within the illustrated preferred embodiment, second stabilizing member 48 has a generally coplanar, perpendicular orientation with respect to base member 40 and with first stabilizing member 42. Consequently, second stabilizing member 48 is generally parallel to first stabilizing member 42. The resulting base assembly 36 has a general "H" shape, configuration, or appearance.

Alternatively, other similar stabilizing members and/or base members could be used to give base assembly 36 a general "A", "C", "L", "M", "N", "O", "S", "U", "V", "W", "X", "Y", "Z", or other comparable shape, configuration, and/or appearance.

As mentioned above, there may not necessarily be a need for base assembly 36. For example, column 38 may be permanently secured to, imbedded into, or formed integrally with support structure 34.

In the preferred embodiment, however, the second component of frame 28 is an elongated, upwardly extending column 38. Column 38 may be formed integrally with base assembly 36 or be securely attached thereto.

If needed, column 38 may also be removably and/or pivotally attached to base assembly 36 to enable apparatus 20 to assume a narrow, thin, or low profile for efficient packaging, shipping, and/or storage.

In the preferred embodiment of the invention, column 38 is fixedly secured to base assembly 36 by any appropriate means, such as by welding, or use of bolts and nuts, screws, pins, or the like.

As seen within FIGS. 1 through 7, column 38 has a first end 50 and an opposed second end 52. First end 50 is preferably secured to base assembly 36.

Alternatively, first end 50 may be independently secured to support structure 34. In which case, first end 50 of column 38 is juxtaposed near, imbedded within, or secured to support structure 34, in such a manner that column 38 extends from support structure 34 in a generally upward direction away from support structure 34.

However, where a stand-alone apparatus 20 is desired, first end 50 may be secured to either base member 40 or to first stabilizing member 42. Preferably, first end 50 is secured to base member 40.

In either case, column 38 extends from base member 40 in a generally upward direction away from support structure 34.

Column 38 need not extend directly upward. Instead, and preferably, column 38 has a generally serpentine configuration. By providing column 38 with a serpentine configuration, the weight of user 26 may be directed to a more centralized location within base assembly 36. Furthermore, column 38 may serve as a stop to limit the forward stroke of apparatus 20 during operation.

To accommodate a wide variety of differently sized users 26, column 38 may be provided with means for telescopic elongation and/or contraction. For example, column 38 may be provided with an elongated first column portion 54 and a second column portion 56.

First column portion 54 has a first end 58 and an opposed second end 60. First end 58 is secured to base member 40 at any appropriate location. First column portion 54 extends generally upward from base member 40 away from support structure 34.

Second column portion 56 is capable of telescopically mating with second end 60 of first column portion 54. Second column portion 56, in effect, defines second end 52 of column 38.

The length of column 38 can be selectively adjusted by telescopically extending and/or contracting second column portion 56 with respect to first column portion 54.

Any appropriate means for accomplishing such telescopic adjustment may be used. For example, first column portion 54 and second column portion 56 may be provided with an operative, engaging rack and pinion system that is positioned therein or therebetween.

Alternatively, a compression bolt and/or knob may be secured to either first column portion 54 or to second column portion 56, or to both, to adjustably contact, engage, and secure the relative positions between such elements.

For purposes of simplicity, the accompanying Figures illustrate first column portion 54 as having a plurality of spaced bore holes 62. Although not necessary, it is intended in the present example or embodiment that there is a corresponding set of bore holes 62 located in an aligned manner on each side of first column portion 54. Such aligned bore holes permit a pin 64 to at least partially pass therethrough.

Second column portion 56 is similarly provided with at least one corresponding set of bore holes 66.

To enable the telescopic elongation and/or contraction of column 38, second column portion 56 is moved upward or downward with respect to first column portion 54. Once a desired elevation is obtained, pin 64 is inserted through aligned bore holes 62 and 66 to secure and affix the relative position of second column portion 56 with respect to first column portion 54.

Column 38 may have both a serpentine configuration and the capability of being telescopically elongated and/or contracted. Where both of these features are desired, first column portion 54 is preferably divided into two joined but differently angled portions, comprising a lower portion 68 and an upper portion 70. Lower portion 68 is attached or connected to base member 40 as described above with first end 58 being secured to base member 40. Lower portion 68, however, is generally inclined with respect to base member 40. Upper portion 70 is secured to an upwardly extending end of lower portion 68. Upper portion 70 has an orientation that is generally collinear or parallel, as the case may be, with telescopic second column portion 56.

As mentioned above, the second primary element of apparatus 20 comprises means 30 for maintaining at least a portion of the upper body or appendage(s) of user 26 at a generally fixed position relative to frame 28. To accomplish this task, maintaining means 30 may comprise a harness, strap, belt, clamp, handle, cuff, platform, bar, and/or other appropriate structure that is or are secured to frame 28.

Where user 26 is handicapped, the most appropriate maintaining means 30 may comprise a harness (not shown) that is secured to the hands, wrists, forearms, arms, or torso of user 26. Maintaining means 30 is then appropriately secured to frame 28.

Alternatively, and preferably, maintaining means 30 comprises at least a first handlebar 72 that is secured to frame 28. First handlebar 72 is positioned generally above and forward of seat assembly 32. First handlebar 72 may be stationary or may not be adjustable for different arm lengths of users 26.

First handlebar 72 may be formed integrally with column 38 and simply be an outward projection therefrom.

Alternatively, first handlebar 72 can be a separate element that is securely attached to column 38. This latter alternative is the preferred embodiment for first handlebar 72, because such a design or structure allows for easy adjustment and alignment.

As seen within the Figures, first handlebar 72 is cantilevered outward from frame 28. It is preferable that first handlebar 72 be cantilevered outward from frame 28 so that at least a portion of first handlebar 72 extends in a direction generally backward toward seat assembly 32.

First handlebar 72 may have a fixed orientation with respect to frame 28.

Figure 2:
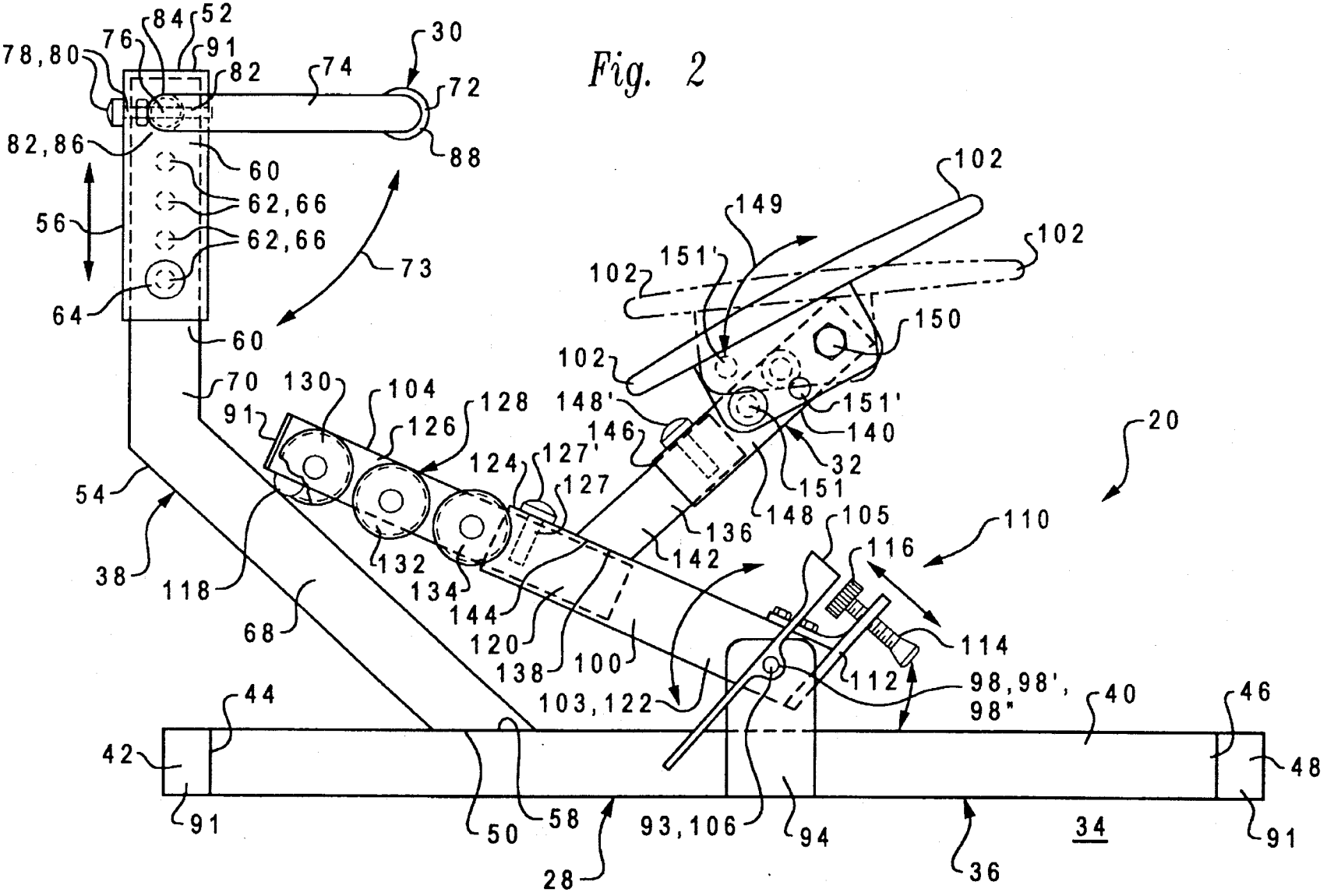
FIG. 2 is a side-elevational view of the preferred embodiment illustrating the various positions of the pivotal seat.

A more utilitarian version of the invention, however, is to attach first handlebar 72 to frame 28 in such a manner that handlebar 72 may be adjustably pivoted through a path, generally defined in FIG. 2 by an arrow 73, to more than a single location. For example, first handlebar 72 may be pivotally secured to frame 28, so that the extended or cantilevered portion 74 is capable of being pivoted about an axis of rotation 76. Such adjustability enables first handlebar 72 to accommodate a wide variety of users having different heights, sitting statures, and arm lengths.

Once a desired pivotal orientation is obtained, first handlebar 72 is fixedly secured to frame 28. In other words, frame 28 is provided with means 78 to adjustably orient and secure first handlebar 72 at any one of a plurality of different pivotal or radial positions with respect to frame 28.

Means 78 for securing first handlebar 72 at a fixed pivotal orientation to frame 28 may comprise one or more gears, a compression bolt and/or knob, and/or one or more pins 80 that pass through mated corresponding bore holes 82 that are located in first handlebar 72 and/or within frame 28. Bore holes 82 are oriented so that pin 80 can hold first handlebar 72 at a variety of different angular or radial orientations with respect to frame 28.

As illustrated in FIG. 1, securing means 78, pin 80, and mated bore holes 82 may be placed within the centrally located second column portion 56 or, alternatively, may be located within one or more extensions 84 or sleeves that protrude outwardly from second column portion 56.

First handlebar 72 is preferably telescopically mated with frame 28. As a result, the length and/or extension of cantilevered portion 74 may be increased or decreased, as needed, to accommodate a wide variety of differently sized users 26. This feature is important because many users 26 will have different arm lengths and the position of first handlebar 72 might need to be adjusted to obtain the most comfortable fit or position for operation of apparatus 20. In other words, first handlebar 72 is provided with means for selectively adjusting its extended length by telescopically extending or contracting first handlebar 72 with respect to frame 28.

To accomplish this end, first handlebar 72 is telescopically inserted into or received by extension 84. First handlebar 72 is provided with at least one corresponding bore hole 86 that can be mated and aligned to bore holes 82.

Preferably, many bore holes 86 are provided within first handlebar 72. The particular bore hole 86 which is aligned with bore hole 82, through which pin 80 is passed, will determine both the length of the cantilevered first handlebar 72 and the angular orientation of first handlebar 72 with respect to frame 28.

Other alternative means for securing first handlebar 72 in a desired pivotal position are readily available within the exercise equipment art.

First handlebar 72 may also be provided with padded handgrips 88 that allow for the comfortable gripping thereof.

In addition, first handlebar 72 may be provided with an end cap 90 to close and seal a terminal end thereof and thereby provide further increased safety for user 26.

End caps 91 can also be used at other locations within frame 28 and/or seat assembly 32 to seal the ends of tubular members.

Although the foregoing discussion primarily focused upon use of first handlebar 72, additional handlebars can be used. For example, FIG. 1 clearly illustrates use of a second handlebar 92. In other words, maintaining means 30 may further comprise second handlebar 92 that is similarly secured to frame 28.

The structure and function of second handlebar 92 is basically identical to that of first handlebar 72. Second handlebar 92 is similarly positioned generally above and forward of seat assembly 32. Second handlebar may be similarly pivotally and/or telescopically secured to frame 28. During use, it is preferred that second handlebar 92 have a generally coplanar or parallel orientation with respect to first handlebar 72.

In other words, orientation of first handlebar 72 and of second handlebar 92, with respect to frame 28, can be easily adjusted by the movement of inserting or removing pins 80 located through both members.

During manufacture of apparatus 20, an elongated rod or tubular member could be passed through extensions 84 or sleeves and then be bent to form first handlebar 72 and second handlebar 92 having the illustrated configuration.

In a further alternative embodiment of the invention, first handlebar 72 and second handlebar 92 may comprise means for providing a resistive force, such as having rubber bands therein that can resist torsional forces, so that under certain forces or tensions, handlebars 72 and 92 will move under pressure.

An important feature of the present invention is that seat assembly 32 is pivotally secured to frame 28. Any adequate means for accomplishing this task may be used. For example, seat assembly 32 may be secured to frame 28 by the use of a hinge (not shown). Alternatively, an elongated pivot pin 93 may be used. Use of pivot pin 93 is preferred, due to the fact that pivot pin 93 may serve more than a single purpose.

To accommodate the placement of pivot pin 93, a first brace 94 or flange is fixedly secured to frame 28. For example, first brace 94 can be fixedly welded to base member 40. If adequate support is provided by first brace 94, no additional support is required.

To increase the safety and stability of apparatus 20, a similar, corresponding second brace 96 or flange may also be used. First brace 94 and second brace 96 generally comprise upwardly extending flanges that are secured to base member 40. Second brace 96 is positioned near first brace 94 in a spaced relationship thereto.

Corresponding, aligned bore holes 98 that are intended to receive pivot pin 93 are located within first brace 94 and second brace 96. Pivot pin 93 functions as a fulcrum and defines a fixed pivot point from which all other measurements and adjustments are made.

Pivotal seat assembly 32 generally comprises an elongated crank 100 or lever and a seat 102. Crank 100 has a first end 103 and an opposed second end 104. First end 103 is provided with a bore hole 98' that can be easily aligned and mated to bore holes 98 located within first brace 94 and second brace 96. Once bore holes 98 and 98' are properly aligned, pivot pin 93 is inserted into and passed therethrough to pivotally secure crank 100 to base assembly 36. Pivot pin 93 actually defines a fixed first axis of rotation for seat assembly 32.

Figure 5:
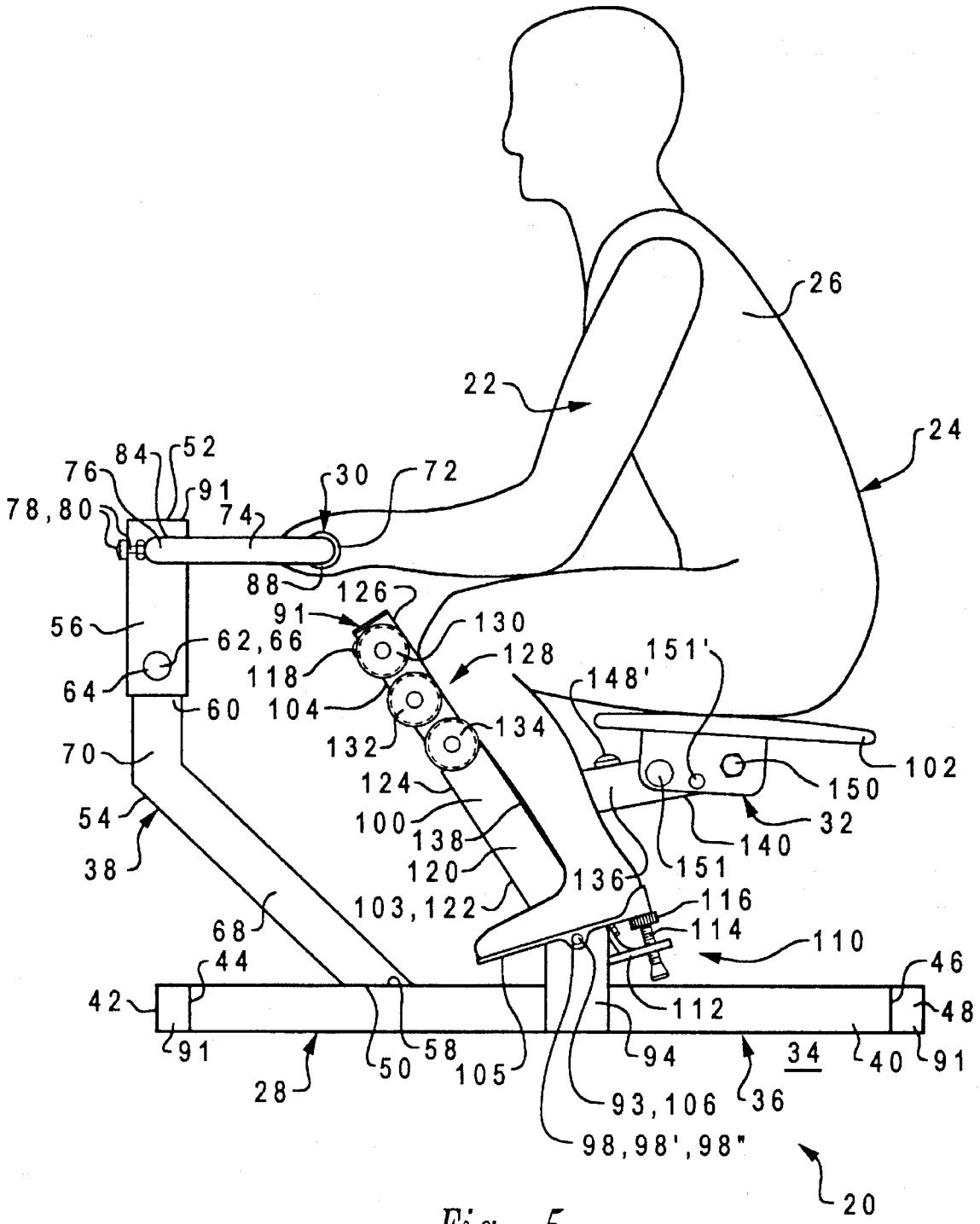
FIG. 5 is a schematic side-elevational view of the invention, wherein the user has placed the seat assembly in a partially lowered or rearward position.
Figure 6:
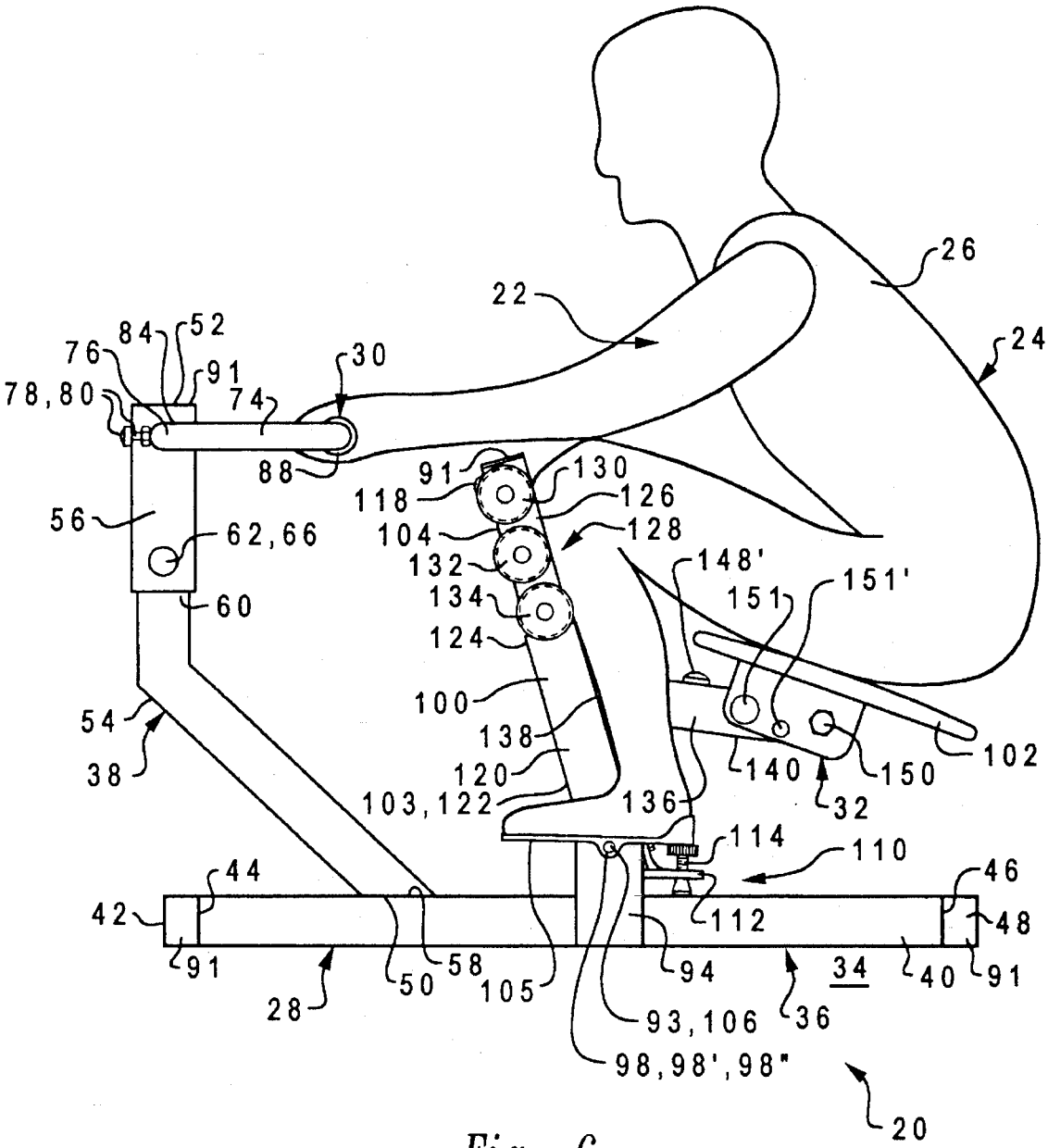
FIG. 6 is a schematic side-elevational view of the invention, wherein the user has placed the seat assembly in its fully lowered or rearward position.

Crank 100 and seat assembly 32 are thereby enabled to pivot or rotate between a raised, forward position (illustrated in FIGS. 1, 2, 4 and 7), and a variable, lower, rearward position (illustrated in FIGS. 3 and 6), or anywhere therebetween (illustrated in FIG. 5).

For convenience and comfort of user 26, and for proper placement of legs of user 26 upon apparatus 20, a first foothold 105 may be secured to frame 28. As illustrated within the Figures, first foothold 105 may be provided with a bore hole 98" that may be similarly mated and aligned with bore holes 98 and 98'. Consequently, first foothold 105 can be easily slid onto pivot pin 93 and there held in place with an end cap 106. Thus positioned, first foothold 105 is pivotally secured to frame 28 and is allowed to pivot as needed.

A second foothold 108 may also be provided. Second foothold 108 is similarly pivotally secured to frame 28.

As best illustrated in FIG. 2, apparatus 20 may also be provided with adjustment means 110 for selectively adjusting a limit to the variable, lower, rearward position of seat assembly 32. In essence, adjustment means 110 adjusts the limit of a backward stroke of crank 100. Adjustment means 110 can be secured to crank 100, to frame 28, or to both.

For example, adjustment means 110 may comprise a threaded brace or bracket 112 that is secured to first end 103. A padded or capped adjusting bolt 114 is inserted through a threaded bore located within bracket 112. The backward throw or stroke of seat assembly 32 can then be easily adjusted by adjusting the length of bolt 114 that protrudes downwardly from bracket 112. At the furthermost portion of the stroke, bolt 114 is urged against frame 28 and, consequently, prevents further rotation of seat assembly 32. Bolt 114 may be provided with an enlarged knob 116 to facilitate easy adjustment thereof.

Figure 3:
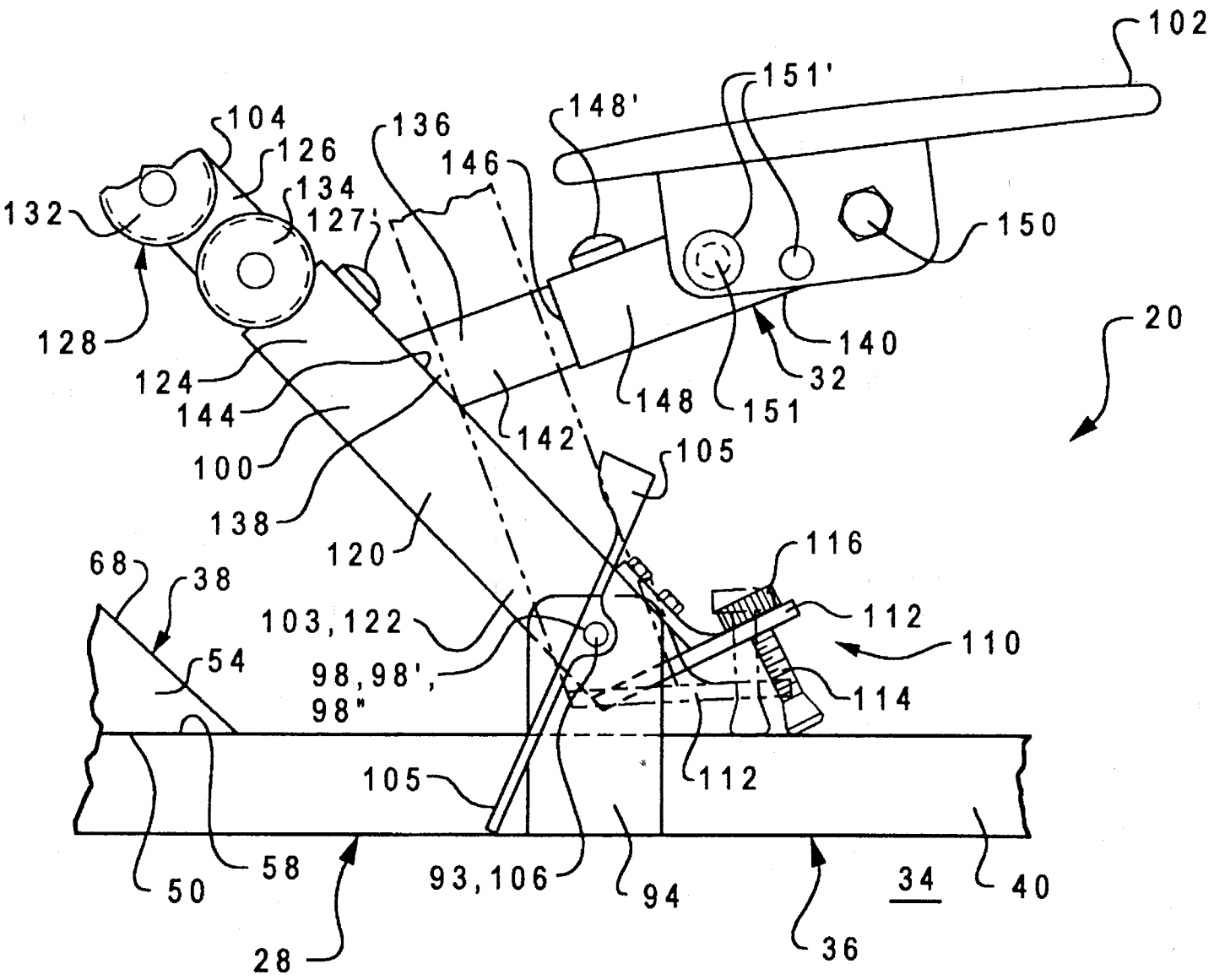
FIG. 3 is a partial, side-elevational view of the embodiment shown in FIGS. 1 and 2, further illustrating the various positions of the adjustment means used to selectively adjust a limit to a backward stroke or throw of the crank.
Figure 4:
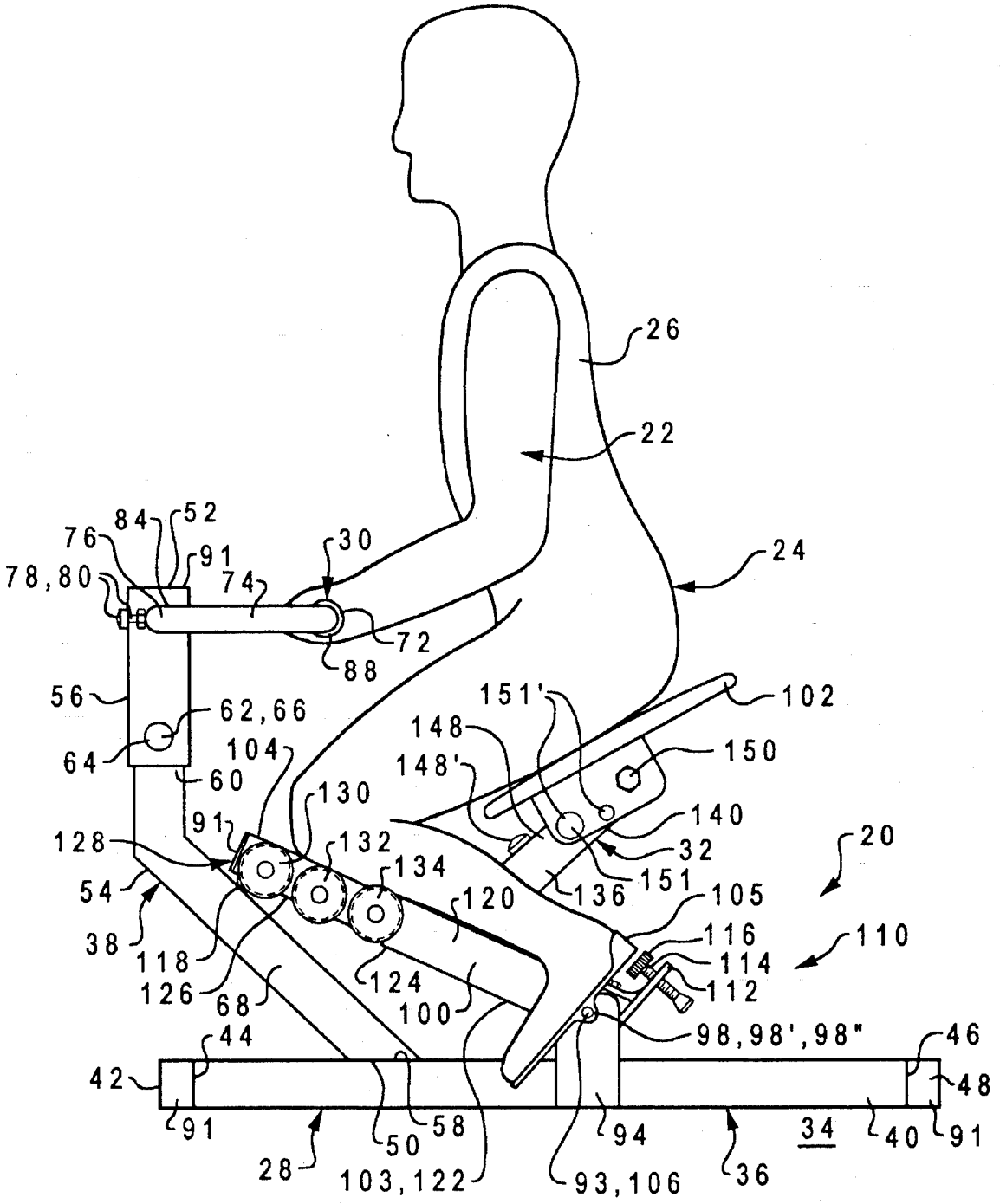
FIG. 4 is a schematic side-elevational view of the invention, wherein a user has placed the seat assembly in its raised forward position.

The solid lines of bolt 114 within FIG. 3 illustrate a first, rearwardmost adjusted position of seat assembly 32. The phantom lines within that same Figure illustrate a second, rearwardmost adjusted position of seat assembly 32. These two positions depict how adjustment of bolt 114 impacts the ultimate angle of inclination of crank 100.

Means for limiting the forward stroke and raised, forward position of crank 100 and seat assembly 32 may also be provided. For example, the aforementioned serpentine column 38 may be positioned to restrict or limit the forward stroke of crank 100.

Further means of adjustment, similar to that of adjustment means 110, may also be provided on or about crank 100 near second end 104 to further adjust the forward stroke of apparatus 20.

Means for absorbing the impact between crank 100 and frame 28 at the end of the forward stroke may also be provided. Such impact absorbing means may comprise a rubber or other impact absorbent bumper 118 that is secured to either crank 100 or to frame 28.

Crank 100 may be provided with means for telescopic elongation and contraction. For example, crank 100 may be provided with an elongated first crank portion 120 that has a first end 122 and an opposed second end 124. First crank portion 120 is pivotally secured to frame 28 near first end 103 and 122. First crank portion 120 extends from frame 28 in a generally upward direction away from support structure 34.

Crank 100 is further provided with a second crank portion 126. Second crank portion 126 is capable of being telescopically mated with second end 124 of first crank portion 120. Second crank portion 126 defines second end 104 of crank 100. The length of crank 100 is selectively adjusted by telescopically extending or contracting second crank portion 126 with respect to first crank portion 120.

To accomplish this task, corresponding bore holes 127 may be provided within first crank portion 120 and within second crank portion 126. A related pin 127' can be easily placed through the aligned bore holes 127 to secure the relative position of first crank portion 120 with respect to second crank portion 126.

As illustrated within the Figures, seat assembly 32 is also provided with a knee and/or shin support assembly 128 that is secured to crank 100. Knee and/or shin support assembly 128 may comprise a stationary padded structure that is secured to crank 100 upon which user 26 may urge his or her shin.

Alternatively and preferably, knee and/or shin support assembly 128 comprises at least a first pair of padded rollers 130 that are pivotally and/or rotatably secured to crank 100 at one or more locations along the length of elongated crank 100. First pair of padded rollers 130 is preferably secured to crank 100 near second end 104.

Knee and/or shin support assembly 128 may further comprise a second pair of padded rollers 132 that are pivotally and/or rotatably secured to crank 100 near padded rollers 130.

Knee and/or shin support assembly 128 may further comprise a third pair of padded rollers 134 that are pivotally and/or rotatably secured to crank 100 near padded rollers 132.

Where two or more pairs of padded rollers 130, 132, and/or 134 are used, such rollers are preferably positioned to maximize the comfort and/or support of user 26 when apparatus 20 is being used. To increase such comfort, padded rollers 130, 132, and 134 are positioned along a generally arcuate path along crank 100 to generally conform to the shape of a user's shin or leg.

Please note that within the preferred embodiment of the invention, padded rollers 130, 132, and 134 are capable of pivoting and also rolling. However, it is not absolutely necessary that such rollers move lengthwise relative to one another.

It is also intended that padded rollers 130, 132, and 134, and padded handgrips 88 be manufactured from neoprene. With the exception of such elements and seat 102, most of the remainder of apparatus 20 is manufactured from steel.

Since the length of crank 100 is selectively adjusted, by telescopically extending or contracting second crank portion 126 with respect to first crank portion 120, padded rollers 130, 132, and 134 can be slid or positioned up or down the length of crank 100 to properly adjust apparatus 20 to fit users 26 having different leg lengths and/or knee lengths.

Seat 102 is secured to crank 100. This is accomplished by providing seat assembly 32 with an elongated seat support 136. Seat support 136 has a first end 138 and an opposed second end 140. First end 138 is secured to crank 100 at an intermediate location between first end 103 and second end 104. Seat support 136 then extends outwardly from crank 100 in a generally upward direction away from crank 100.

Although not absolutely necessary, as illustrated in FIGS. 2, 3, 4, and 7, elongated seat support 136 may also be capable of being telescopically elongated and/or contracted. For example, seat support 136 may comprise an elongated first seat support portion 142 having a first end 144 and an opposed second end 146. First end 144 is secured to crank 100 as described above and illustrated in the accompanying Figures. First seat support portion 142 then extends from crank 100 in a generally upward direction away from crank 100.

Seat support 136 also has a second seat support portion 148 that is capable of telescopically mating with second end 146 of first seat support portion 142. Second seat support portion 148 defines second end 140 of seat support 136. First seat support portion 142 and second seat support portion 148 are each provided with mated alignable bore holes and a corresponding pin 148', similar to those described above, to enable securing such elements to one another once a proper telescopic position is obtained. As a result, the length of seat support 136 is capable of being selectively adjusted by telescopically extending and/or contracting second seat support portion 148 with respect to first seat support portion 142.

Pivotal seat assembly 32 also has seat 102 attached thereto. Seat 102 may take any appropriate form or configuration. Seat 102 illustrated in the Figures has a generally elongated, trapezoidal configuration with its apex positioned nearer to first handlebar 72 and to second handlebar 92. Other seat designs, however, may be used with similar overall effect.

The shape of seat 102 is primarily based upon comfort for user 26. Consequently, sufficient padding should be placed along a front or forward edge of seat 102 where a lot of pressure will occur during operation of the traction exercise.

Seat 102 is preferably secured to seat support 136 near second end 140 of seat support 136.

Although not required, seat 102 may be pivotally secured to seat support 136 so that seat 102 can pivotally oscillate through an arc or arcuate path generally defined by arrow 149 in FIG. 2. Furthermore, thus enabled, seat 102 is capable of oscillating about a second axis 150 of rotation relative to seat support 136 to generally move toward or away from maintaining means 30.

Seat 102 may be positioned to maintain its pivotal freedom throughout the exercise. Under such circumstances, pin 151 is not used or inserted into apparatus 20.

Alternatively, seat 102 may be provided with means to secure against further pivotal movement of seat 102 with respect to seat support 136. In other words, seat 102 can be locked into a generally stationary position relative to seat support 136. For example, pin 151 may be inserted into aligned, mated bore holes 151' located in both a downwardly extending flange of seat 102 and in seat support 136, and thereby prevent further relative pivotal movement between these two elements.

Means may also be provided to lock seat 102 at any desired angle of inclination with respect to seat support 36.

Apparatus 20 may also be provided with means 152 for urging seat assembly 32 to return to its raised, forward position. Such urging means 152 is preferably secured to frame 28 and to seat assembly 32. For example, urging means 152 may comprise a spring, or an elastic member or band that does not necessarily provide resistive forces for exercising the lumbar region 24 of user 26, but rather is intended simply to retract, pull, push, or orient seat 102 back to its original upright position when apparatus 20 is not in use.

Where a spring-loaded seat 102 is used, the spring urges seat 102 toward its original upright position where the front forwardmost edge of seat 102 is lowermost.

Figure 7:
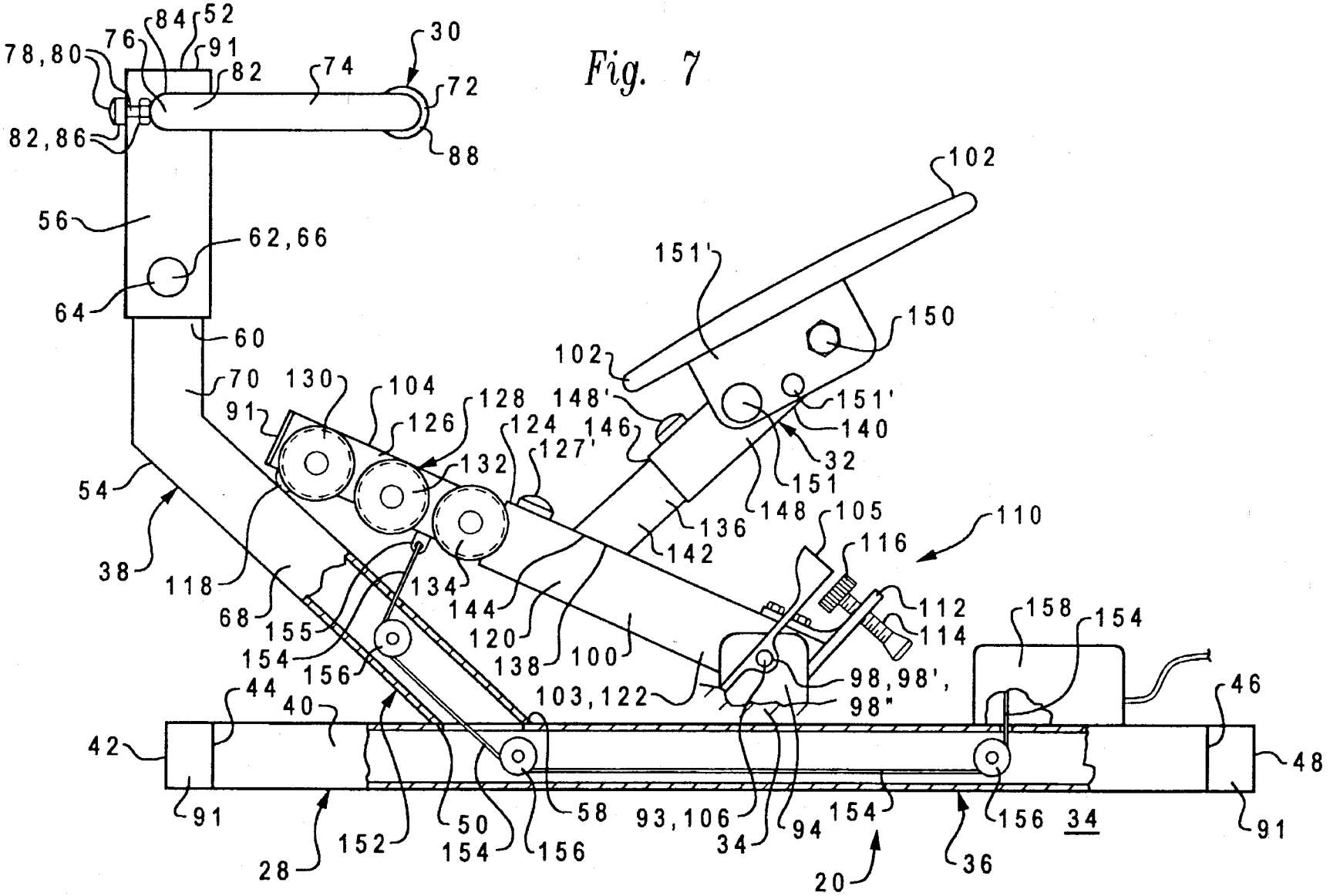
FIG. 7 is a partial, cross-sectional, side-elevational view of another embodiment of the invention, wherein means for urging the seat assembly to return to its raised, forward position is illustrated.

Alternatively, as illustrated in FIG. 7, urging means 152 may comprise a cable 154 and related linkages, pulley rollers 156, and a powered motor 158 that can be activated to pull and possibly push seat assembly 32 back to its raised, forward position. Cable 154 is secured to crank 100 at a location 155 by any appropriate means.

This alternative embodiment illustrated in FIG. 7 is particularly helpful for persons who do not have sufficient upper body strength to pull their own weight back to the raised position. In essence, motor 158 and the cable assembly comprising cable 154 and pulley rollers 156 serve to assist user 26 to move back to a raised position. Other structures to obtain this same result could alternatively be used.

In a further embodiment of the invention, not illustrated, seat 102 may be provided with a padded back against which the user may lean if needed.

During operation of the invention, user 26 sits upon seat 102 and places his or her feet within first foothold 105 and within second foothold 108. User 26 then places his or her shins and knees against the padded rollers 130, 132, and 134. At this point, the center of gravity of user 26 is substantially forward of pivot pin 93. Consequently, seat assembly 32 will not move. This initial, raised, forward position generally causes user 26 to maintain a kneeling-like position when seat 102 is in its forwardly inclined position.

While in this position, the pelvis of user 26 is generally locked and will not be adversely affected by the performance of this exercise.

User 26 then grips padded handgrips 88 and begins to push away from first handlebar 72 and from second handlebar 92.

In direct response to the pushing action of user 26, seat assembly 32 rotates or pivots backward away from column 38. Pivot pin 93 functions as a fulcrum for this pivotal motion. User 26 may continue to push backward until his or her center of gravity is directly above pivot pin 93. User 26 can continue to hold onto handlebars 72 and 92 and continue to push backward. This action causes a variable amount of the user's own body weight to become a controlled force of traction on the user's lumbar region 24.

The position the user's body assumes places a mild force against the kneepads and upper portion of the leg.

As user 26 pivots backward, a mild force is continually applied through the arcuate range of movement with an increasing amount of force. The further user 26 allows himself or herself to move rearward will directly increase or decrease the amount of inherent traction within the lumbar region 24. In effect, apparatus 20 causes user 26 to perform a controlled pelvic tilt to stretch the lower back muscles.

As the pelvic tilt is being performed, much of the weight of user 26 is transferred from the spine to the user's thigh and femurs. Much of the pressure is also exerted against the shins and knees of user 26 along a generally linear line. In other words, the main thrust of the present invention is to actually place the weight of user 26 to the front and to the sides of user 26 and, thereby, remove such weight from the lower back or lumbar region 24 of user 26.

As user 26 passes over the apex of the pivotal movement, the pelvis is pushed slightly downward. The weight of the user's body is then shifted forward so that the thighs and front of the knees bear most of the body's weight. Consequently, the lumbar spine is placed in traction. The head of user 26 also naturally moves forward over the knees. In essence, the user's weight shifts to the front of his or her thighs so that the pressure is being applied in a downward force, the spine is unloaded, and traction occurs.

In other words, as crank 100 passes over or through the arcuate range of movement toward the rearward position, the spine becomes unloaded of weight. In effect, the weight shifts from behind the user to underneath the top of the user's leg. This action applies a downward force along the upper portion of the leg and applies a force to the lumbar spine and related muscles.

There is little or no weight placed on the lumbar spine. Rather, a downward force is applied to stretch the lumbar spine and muscles. The pelvis remains locked. The pelvis is stabilized by feet being placed on the foot pedals and the knees being urged against the kneepads. Consequently, a force is applied to the leg and femur bone by locking the shin against the rollers and the knee against the support pads.

Please note that user 26 is in complete control over the amount and duration of traction that is being exerted by limiting the amount of flexion that occurs and the pivotal arc that is passed through. User 26 is not dependent upon the assistance of an independent operator or supervisor. Nor is user 26 subject to unyielding weights that are not sensitive to the particular momentary needs of user 26. This invention gives the user 26 complete control over how the traction is performed. In effect, user 26 is performing his or her own traction.

It is the intention of the inventor that apparatus 20 be used with a slow, easy downward movement until the force being exerted on the knee pushes bilaterally along the femur in a tangential direction to the changing rotational movement.

In essence, the traction to the lower back to stretch the muscles in the back is primarily caused by the relative angles of the femur to the user's pelvis during the course of the exercise.

There are no undue forces being applied anywhere else to the body of user 26. For example, use of this invention does not place any undue torsional stresses upon the lower back of user 26. Nor is the back of user 26 being subjected to undue compressive stress. Once the muscles within the lumbar region 24 are strengthened, pre-existing pain should be significantly relieved.

After user 26 reaches the predetermined maximum backward stroke, user 26 pulls on handlebars 72 and 92 to pull himself or herself back to the initial position. Consequently, the shoulder and arm muscles are exercised. Please note that there is a variable amount of controlled resistance during both the forward and rearward strokes with the present invention.

If a greater amount of traction is desired, the stop mechanism or adjustment means 110 can be adjusted to allow a further backward stroke. In addition, or alternatively, the angle of the seat can also be adjusted to obtain a greater amount of traction.

Throughout the exercise, it is intended that seat 102 be pivoted with respect to seat support 136 only about 15 to 20 degrees. The reason for using a pivotal seat 102 is that during the exercise, the plane of seat 102 changes. The further backward the inclination of seat 102, the more traction will occur in the lower back. Some users 26 will be able to stretch to a 5 degree limit, other users 26 can stretch only to a 10 degree limit.

Seat 102 does not have to pivot with respect to seat support 136 to accomplish this exercise.

Although not necessary, the preferred embodiment of the invention enables the feet and legs of user 26 to pivot off of the floor as user 26 pivots backward. This feature assists in the comfort of user 26 during the exercise and eliminates unnecessary limitations upon the body of user 26.

If a motor is provided as described above, a switch or actuator on apparatus 20 can be tripped to automatically bring the machine up to its original position.

In effect the invention provides a new apparatus and method for performing an extension or flexion exercise for the lumbar spin. The paravertebral muscles apply a force to the knees each time the flexion exercise is performed on the machine.

The means and construction disclosed herein are by way of example and comprise primarily the preferred form of putting the invention into effect. Although the drawings depict a preferred and alternative embodiment of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all alternatives, modifications, equivalents, and alternative embodiments which fall within the legitimate and valid scope of the appended claims, appropriately interpreted under the Doctrine of Equivalents.

INDUSTRIAL APPLICABILITY

The present invention may be used within the medical, therapeutic, health, body-building, and exercise professions and/or industries, wherein safe, reliable, simple, easily used, and efficient apparatus is needed to provide controlled traction of variable strength and/or duration to the lumbar region of a patient and/or user. This invention comprises ideal apparatus for use within therapeutic, body-building, and exercise equipment. The apparatus of this invention is durable, rugged, functional, unobtrusive, is easily constructed, and is inexpensive and economical to manufacture. The present invention not only increases the speed and simplifies the procedure to set up equipment for exercising the lumbar region of a user, it also provides an apparatus that provides a greater amount of exercise in a lesser amount of time, and does not expose the operator to danger or injury.

What is claimed is:

1. An apparatus to exercise and strengthen a lumbar region of a user, comprising:

a frame;

first and second braces secured to said frame;

means secured to the frame for maintaining at least a portion of the upper body of the user at a generally fixed position relative the frame;

a seat assembly comprising an elongated crank or lever having a first end and an opposed second end and a seat secured to said crank, said crank being pivotally secured to said first and second braces by means of an elongated pivot pin that passes through mated bore holes located within said crank and said first and second braces, said pivot pin defining a first fixed axis of rotation for said seat assembly for rotation of said seat between a raised forward position and a lowered rearward position toward and away from said maintaining means; and means for securing a foot of a user against translational movement when the user sits upon said seat comprising a first foothold pivotally secured to said frame by means of said pivot pin passing through a mated bore hole located within said first foothold, whereby a user may sit in said seat with their foot engaging said foothold and engage the maintaining means and exercise their lumbar region by pivoting the crank away from said maintaining means, thereby using a portion of their body weight to apply a controlled traction to their lumbar region.

2. The apparatus of claim 1, further comprising a second foothold pivotally secured to said frame by means of said elongated pivot pin passing through a mated bore hole located within said second foothold.

3. An apparatus to exercise and strengthen a lumbar region of a user, comprising:

a frame;

means secured to the frame for maintaining at least a portion of the upper body of the user at a generally fixed position relative the frame;

a seat assembly comprising an elongated crank or lever having a first end and an opposed second end and a seat secured to said crank, said crank being pivotally secured to said frame for rotation of said seat between a raised forward position and a lowered rearward position toward and away from said maintaining means; and a knee or shin support assembly secured to said crank for supporting the knee or shin of a user seated on said seat, whereby a user may sit in said seat with their knee or shin supported by said knee or shin support and engage the maintaining means and exercise their lumbar region by pivoting the crank away from said maintaining means, thereby using a portion of their body weight to apply a controlled traction to their lumbar region.

4. The apparatus of claim 3, wherein said knee or shin support assembly comprises a first pair of padded rollers that are pivotally or rotatably secured to said crank near said second end of said crank.

5. The apparatus of claim 4, wherein said knee or shin support assembly further comprises a second pair of padded rollers that are pivotally or rotatably secured to said crank near said first pair of padded rollers.

6. The apparatus of claim 5, wherein said knee or shin support assembly further comprises a third pair of padded rollers that are pivotally or rotatably secured to said crank near said second pair of padded rollers.

* * * * *